US012735228B2

(12) United States Patent
Trammel et al.

(10) Patent No.: US 12,735,228 B2
(45) Date of Patent: Sep. 15, 2026

(54) CHILD-RESISTANT FRONT-OPENING RECLOSABLE ENCLOSURE

(71) Applicant: Illinois Tool Works Inc., Glenview, IL (US)

(72) Inventors: Michael A. Trammel, Sandy Hook, CT (US); David Matthews, Gilman, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 166 days.

(21) Appl. No.: 17/936,558

(22) PCT Filed: Apr. 12, 2021

(86) PCT No.: PCT/US2021/026869
§ 371 (c)(1),
(2) Date: Sep. 29, 2022

(87) PCT Pub. No.: WO2021/211447
PCT Pub. Date: Oct. 21, 2021

(65) Prior Publication Data

US 2024/0228120 A1 Jul. 11, 2024

Related U.S. Application Data

(60) Provisional application No. 63/009,214, filed on Apr. 13, 2020.

(51) Int. Cl.
*B65D 33/00* (2006.01)
*B65D 33/25* (2006.01)

(52) U.S. Cl.
CPC ..... *B65D 33/007* (2013.01); *B65D 33/2533* (2013.01); *B65D 33/2583* (2013.01); *B65D 2215/08* (2013.01)

(58) Field of Classification Search
CPC ..... B65D 33/007; B65D 33/2533; B65D 33/2583; B65D 2215/08
(Continued)

(56) References Cited

U.S. PATENT DOCUMENTS 2,789,609 A 4/1957 Louis
5,167,455 A * 12/1992 Forman ..... B65D 33/20 383/211
(Continued)

FOREIGN PATENT DOCUMENTS

| | | |
|---|---|---|
| CN | 108577109 A | 9/2018 |
| DE | 10340099 | 3/2005 |
| WO | 2019028216 | 2/2019 |

OTHER PUBLICATIONS

International Preliminary Report on Patentability received for related PCT Application No. PCT/US2021/026869 mailed Oct. 27, 2022 (7 pages).
(Continued)

*Primary Examiner* — Peter N Helvey
(74) *Attorney, Agent, or Firm* — Carroll, Hoette & Butscher, LLC; Christopher R. Carroll

(57) ABSTRACT

A reclosable enclosure includes front and back panels and a reclosable mechanism. The front panel and the back panel are coupled to each other and form an interior cavity therebetween. The front panel is configured to form an access slot that extends widthwise along the front panel. The reclosable mechanism is coupled to an interior side of the front panel along the access slot. The reclosable mechanism has a first profile and a second profile forming a zipper. The first profile includes a user tab that is accessible through the access slot. The user tab is configured to assist in separating the first and second profiles to provide an opening to the interior cavity of the reclosable enclosure.

16 Claims, 5 Drawing Sheets

(58) Field of Classification Search
USPC ..... 383/204
See application file for complete search history.

(56) References Cited

U.S. PATENT DOCUMENTS

| | | | | | |
|---|---|---|---|---|---|
| 5,167,608 | A * | 12/1992 | Steffens, Jr. | B65D 33/2583 | 53/381.2 |
| 5,461,845 | A * | 10/1995 | Yeager | B65D 33/2533 | 383/203 |
| 5,806,984 | A * | 9/1998 | Yeager | B65D 33/2533 | 383/66 |
| 5,823,933 | A | 10/1998 | Yeager | | |
| 5,829,884 | A * | 11/1998 | Yeager | B65D 33/2541 | 383/203 |
| 5,902,047 | A * | 5/1999 | Yeager | B65D 33/2533 | 383/203 |
| 5,954,433 | A * | 9/1999 | Yeager | B65D 33/2533 | 383/203 |
| 6,004,032 | A | 12/1999 | Kapperman et al. | | |
| 6,079,878 | A * | 6/2000 | Yeager | B65D 33/2533 | 383/203 |
| 6,177,172 | B1 | 1/2001 | Yeager | | |
| 6,270,257 | B1 * | 8/2001 | Yeager | B65D 33/2533 | 383/203 |
| 6,779,921 | B2 * | 8/2004 | Yeager | B65D 33/002 | 206/730 |
| 6,991,372 | B2 * | 1/2006 | Cornelisse | B65D 33/2575 | 383/203 |
| 7,553,083 | B2 * | 6/2009 | Plourde | B65B 51/303 | 383/203 |
| 7,874,731 | B2 * | 1/2011 | Turvey | B65D 81/2023 | 383/103 |
| 10,287,063 | B2 | 5/2019 | Rojas et al. | | |
| 2007/0092166 | A1 | 4/2007 | Anzini et al. | | |
| 2016/0122087 | A1 | 5/2016 | Takigawa | | |
| 2017/0152085 | A1 | 6/2017 | Rojas et al. | | |
| 2020/0108979 | A1 * | 4/2020 | Septien Rojas | B65D 33/2508 | |

OTHER PUBLICATIONS

Office Action received for related BR Application No. 112021006283-1 dated Jan. 5, 2023 (7 pages).

* cited by examiner

CHILD-RESISTANT FRONT-OPENING RECLOSABLE ENCLOSURE

CROSS-REFERENCE TO RELATED APPLICATIONS

This application is a national phase entry of and claims priority to International Patent Application No. PCT/US2021/026869 (filed 12 Apr. 2021), which claims priority to U.S. Provisional Application No. 63/009,214 (filed 13 Apr. 2020). The entire disclosures of these applications are incorporated herein by reference.

BACKGROUND

Technical Field

The subject matter of the present application relates to flexible, reclosable enclosures.

Discussion of Art

Child-resistant packages are designed to hold contents that may be dangerous or inappropriate for children, such as medicinal drugs, detergent capsules, or similar items. Some known child-resistant packages are rigid containers (e.g., jars or bottles) that have specially-designed lids that must be squeezed or pushed in particular techniques to remove the lid and expose the contents. The particular techniques may not be apparent to a child and/or may require an amount of force that is beyond the strength of a child. The rigid child-resistant containers may be complicated and costly to manufacture. Additionally, such containers may be relatively expensive to transport and recycle due to the rigid structure and weight of the containers and lids. Alternative enclosures are desired that are child-resistant and more flexible.

BRIEF DESCRIPTION

In one or more embodiments, a reclosable enclosure is provided that includes front and back panels and a reclosable mechanism. The front panel and the back panel are coupled to each other and form an interior cavity therebetween. The front panel is configured to form an access slot that extends widthwise along the front panel. The reclosable mechanism is coupled to an interior side of the front panel along the access slot. The reclosable mechanism has a first profile and a second profile forming a zipper. The first profile includes a user tab that is accessible through the access slot. The user tab is configured to assist in separating the first and second profiles to provide an opening to the interior cavity of the reclosable enclosure.

Optionally, the reclosable mechanism may include a race-track seal that secures at least one of the first profile or the second profile to the interior side of the front panel, with the race-track seal surrounding the access slot. Optionally, the reclosable mechanism is discrete and spaced apart from the back panel.

Optionally, the first profile may include a first interlocking element and the second profile includes a second interlocking element, with the first and second interlocking elements separably connectable to provide the zipper. The user tab of the first profile may project from an edge of the first profile towards the access slot. Optionally, the first profile includes a lower sealed portion fixedly attached to the interior side of the front panel and a separable upper flange extending from the lower sealed portion. The separable upper flange may include the first interlocking element and the user tab. The separable upper flange may be separated from the interior side of the front panel while the first and second interlocking elements are connected to each other, thereby permitting the access slot to at least partially open without separating the first and second interlocking elements.

Optionally, the front panel may form a pull flap that projects above an upper edge of the first profile, and the pull flap is configured to be pulled by a user to enlarge the access slot and provide access to the user tab.

Optionally, the first profile and the second profile are coupled to each other at first and second crushed sections, and the first and second profiles define the opening to the interior cavity between the first and second crushed sections when the first and second profiles are separated.

Optionally, the front panel includes a removable strip on an exterior surface of the front panel covering the access slot, and the access slot is exposed after the removable strip is at least partially removed. Optionally, the front panel includes a line of weakness, and the access slot is formed after the line of weakness is broken.

Optionally, the front panel includes an upper portion above the access slot and a lower portion below the access slot, with the upper portion integrally connected to the lower portion at opposite ends of the access slot. The first profile may be fixedly attached to the lower portion, and the second profile may be fixedly attached to the upper portion.

Optionally, the first profile has a first lower interlocking element extending continuously along the first profile and the user tab includes a tab-locking element. The second profile has a second lower interlocking element and a second upper interlocking element that both extend continuously along the second profile. The first and second lower interlocking elements may be separably connectable to provide the zipper, and the tab-locking element may be separably connectable to the second upper interlocking element of the second profile.

Optionally, the first profile includes a first upper interlocking element parallel to the first lower interlocking element, and the user tab is configured to be received in a gap between first and second segments of the first upper interlocking element. The first and second upper interlocking elements may be separably connectable to each other and can be separated from each other while the tab-locking element remains connected to the second upper interlocking element.

In one or more embodiments, a reclosable enclosure is provided that includes front and back panels and a reclosable mechanism. The front panel and the back panel are coupled to each other and form an interior cavity therebetween. The front panel is configured to form an access slot that extends widthwise along the front panel. The reclosable mechanism is coupled to an interior side of the front panel along the access slot. The reclosable mechanism has a first profile and a second profile. The first profile includes a first interlocking element, and the second profile includes a second interlocking element. The first and second interlocking elements are separably connectable to provide a zipper. The first profile also includes a user tab that is accessible through the access slot. The user tab is configured to assist in separating the first and second interlocking elements to provide an opening to the interior cavity of the reclosable enclosure. The first profile includes a lower sealed portion fixedly attached to the interior side of the front panel and a separable upper flange extending from the lower sealed portion. The first interlocking element and the user tab are disposed on the separable upper flange. The separable upper flange is configured to be separated from the interior side of the front panel while the first and second interlocking elements are connected to each other, thereby permitting the access slot to at least partially open without separating the first and second interlocking elements.

Optionally, the user tab is a free-standing flap that projects from an upper edge of the first profile along the separable upper flange. Optionally, the front panel forms a pull flap that projects above the upper edge of the first profile, and the pull flap can be pulled by a user to enlarge the access slot and provide access to the user tab. Optionally, the front panel includes a removable strip on an exterior surface of the front panel covering the access slot, and the access slot is exposed after the removable strip is at least partially removed.

Optionally, the reclosable mechanism includes a race-track seal that secures at least one of the first profile or the second profile to the interior side of the front panel, with the race-track seal surrounding the access slot.

Optionally, the first profile and the second profile are coupled to each other at first and second crushed sections. The first and second profiles may define the opening to the interior cavity between the first and second crushed sections when the first and second profiles are separated.

In one or more embodiments, a reclosable enclosure is provided that includes front and back panels and a reclosable mechanism. The front panel and the back panel are coupled to each other and form an interior cavity therebetween. The front panel is configured to form an access slot that extends along the front panel. The reclosable mechanism is coupled to an interior side of the front panel along the access slot. The reclosable mechanism has a first profile and a second profile. The first profile has a first lower interlocking element extending continuously along the first profile. The second profile has a second lower interlocking element and a second upper interlocking element that both extend continuously along the second profile. The first and second lower interlocking elements are separably connectable to provide a zipper. The first profile also includes a user tab that is accessible through the access slot. The user tab is configured to assist in separating the first and second lower interlocking elements to provide an opening to the interior cavity of the reclosable enclosure. The user tab includes a tab-locking element that aligns with and is separably connectable to the upper interlocking element of the second profile.

Optionally, the first profile includes a first upper interlocking element parallel to the first lower interlocking element, and the user tab can be received in a gap between first and second segments of the first upper interlocking element. The first and second upper interlocking elements may be separably connectable to each other and can be separated from each other while the tab-locking element of the user tab remains connected to the second upper interlocking element.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
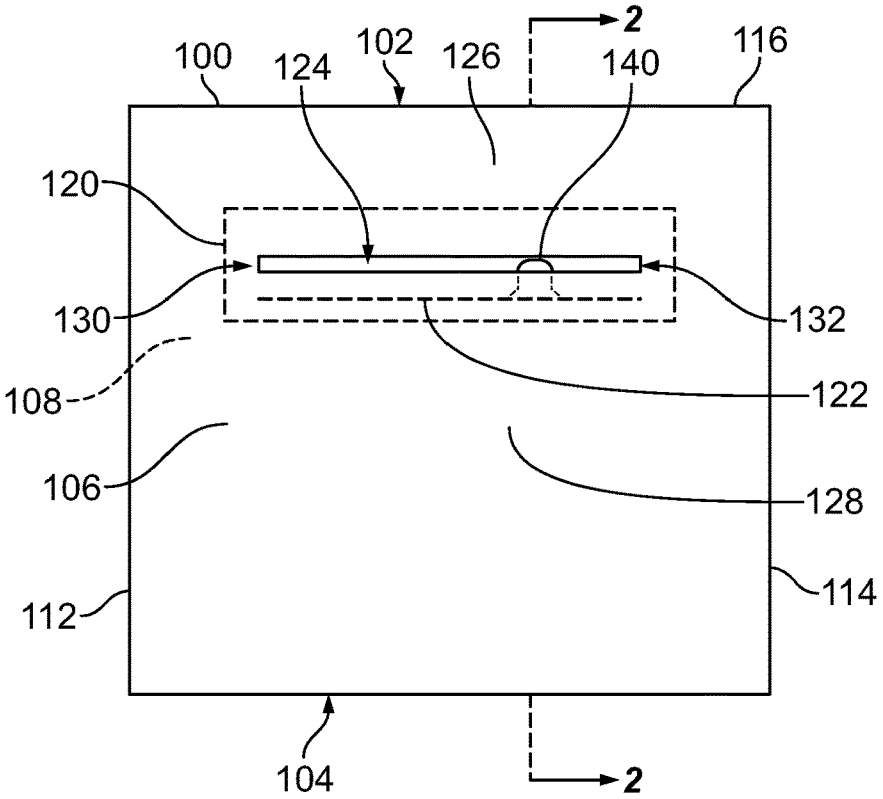
FIG. 1 illustrates a reclosable enclosure according to an embodiment of the present disclosure.

Embodiments set forth herein include a reclosable front-opening flexible enclosure. Flexible enclosures (e.g., box lines, plastic packages, and the like) can be used to hold a wide variety of contents. Flexible enclosures have become more popular because such enclosures can cost less than alternatives, such as rigid container, and can be readily opened but also sealed to provide sufficient protection of the contents therein. A reclosable enclosure enables a user to repeatedly open the enclosure, remove a portion of the contents from the enclosure, and then close the enclosure in a manner that seals the contents therein. In many cases, these reclosable enclosures are torn or ripped when initially opened. Despite being irreparably altered, the reclosable enclosures are configured to reseal the opening to protect the contents from the surrounding environment and/or prevent the contents from inadvertently exiting the enclosure. Compared to user-improvised methods (e.g., rolling the top of a flexible bag and/or mounting a clamp or clip on the bag), reclosable enclosures are tidier and reassure the user that the contents are protected and will not spill if the enclosure is mispositioned or dropped.

Front-opening reclosable enclosures have an access slot along a front of the enclosure below the top end of the enclosure. Opening the enclosure through the access slot retains the integrity of the package along the entire boundary, including the top end, the bottom end opposite the top end, and side edges that extend from the bottom end to the top end. Because the boundary of the enclosure is unaltered, even after opening the enclosure, the front-opening reclosable enclosures protect the contents from the surrounding environment and/or prevent the contents from inadvertently exiting the enclosure.

Embodiments of the flexible, front-opening reclosable enclosure described herein include child-resistant or child-deterrent tab features. The tab features are designed to deter or prevent a child from opening the enclosure to access the contents within the enclosure. For example, the enclosures described herein include reclosable mechanisms with grippable tab features that are manipulated in order to open the reclosable mechanism. For example, the reclosable mechanisms of the embodiments may not be unlocked or unzipped merely by pulling front and back panels of the enclosures in opposite directions without manipulating the tab feature. The incorporation of the tab feature child-proofs the enclosure because a child may not be able to locate the tab feature, may not mentally comprehend the function of gripping and pulling the tab feature, and/or may not be physically strong enough or dexterous to complete the task of gripping and pulling the tab feature to unzip the reclosable mechanism.

In the following description and claims, relative or spatial terms such as "front," "back," "side," "top," "bottom," "lateral," "longitudinal," and the like are only used to distinguish the referenced elements or features with respect to one another and make the language more readily understandable. The terms do not necessarily require particular positions, sizes, or orientations relative to the surrounding environment. Moreover, in the following description and claims, the terms "first," "second," and "third," etc. may be used as labels to distinguish similar elements (e.g., first and second side walls) and are not intended to impose numerical requirements on their objects.

Figure 2:
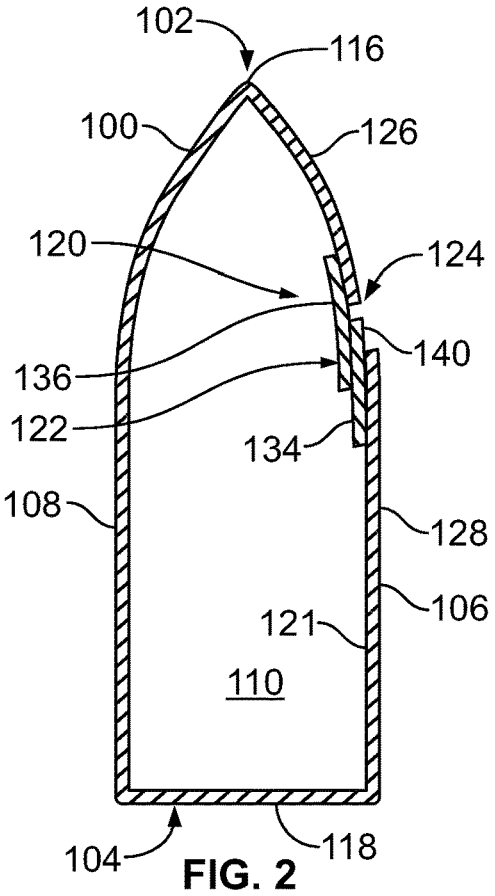
FIG. 2 illustrates a cross-section of the reclosable enclosure in a closed state.

FIG. 1 illustrates a reclosable enclosure 100 according to an embodiment of the present disclosure. FIG. 2 illustrates a cross-section of the reclosable enclosure 100 in a closed state. The cross-section is taken along line 2-2 in FIG. 1. The reclosable enclosure 100 extends a height from a top end 102 to a bottom end 104 that is opposite the top end 102. The enclosure 100 includes a front panel 106 and a back panel 108. The front panel 106 is coupled to the back panel 108 and form an interior cavity 110 therebetween. The front panel 106 and back panel 108 may be essentially rectangular sections having edges. In the illustrated embodiment, the front panel 106 is fixedly attached to the back panel 108 to define a left edge 112, a right edge 114, and a top edge 116 of the enclosure 100. The enclosure 100 also includes a bottom panel 118 that extends between the first and second panels 106, 108 and is fixedly attached to both panels 106, 108. The bottom panel 118 defines a bottom of the interior cavity 110. In an embodiment, the corresponding panels 106, 108, 118 are fixedly attached by sealing (e.g., bonding) respective edges together to seal the interior cavity 110 from the external environment. Optionally, the enclosure 100 may provide an airtight seal.

The enclosure 100 can have various shapes in different embodiments, including different numbers and arrangements of panels. For example, the front and back panels 106, 108 of the enclosure 100 optionally may be indirectly coupled to each other via side walls that extend the height of the enclosure 100. The side walls may form gussets that enable enlarging of the interior cavity 110, such as by the contents that are loaded into the interior cavity 110. In another embodiment, the enclosure 100 may lack the discrete bottom panel 118 shown in FIG. 2 such that the front panel 106 directly attaches to the back panel 108 at the bottom end 104. In particular embodiments, the flexible enclosure may be manufactured using a known pouch-making machine. The reclosable enclosure 100 can be composed of a polymer material. In a non-limited example, the panels 106, 108, 118 can be composed of polyethylene terephthalate (PET) laminate film. PET laminate film offers high seal integrity and good moisture barrier characteristics.

The enclosure 100 includes a reclosable mechanism 120 that is coupled to an interior side 121 of the front panel 106. The interior side 121 defines a portion of the interior cavity 110. The reclosable mechanism 120 laterally extends along a width of the front panel 106 between the left and right edges 112, 114. For example, the reclosable mechanism 120 is longer in the width direction than the vertical direction. The reclosable mechanism 120 defines an intermeshable closure member, referred to herein as a zipper 122. The reclosable mechanism 120 is discrete and spaced apart from the back panel 108. For example, the back panel 108 may continuously extend the height and width of the enclosure 100 without any openings.

The zipper 122 may include strips of a structured surface having ridges and troughs that can mate with itself. The zipper 122 is formed by a first profile 134 and a second profile 136 of the reclosable mechanism 120. For example, the first and second profiles 134, 136 may include two opposing hook-filled strips having the same or similar structures. When brought together, the hooks of one strip may couple to the hooks of the opposing strip, thereby sealing the enclosure 100.

The front panel 106 defines an access slot 124 that extends widthwise. In the illustrated embodiment, the access slot 124 is oriented approximately parallel to the top end 102 and the bottom end 104 of the enclosure 104. The access slot 124 is spaced apart from and located between the top and bottom ends 102, 104. The front panel 106 defines an upper portion 126 above the access slot 124 and below the top end 102. A lower portion 128 of the front panel 106 is below the access slot 124 and above the bottom end 104. The access slot 124 in an embodiment does not extend the full width of the front panel 106, so the upper and lower portions 126, 128 are integrally connected at opposite ends 130, 132 of the access slot 124. In the illustrated embodiment, the first profile 134 of the reclosable mechanism 120 is fixedly attached to the lower portion 128 of the front panel 106, and the second profile 136 is fixedly attached to the upper portion 126. For example, the first profile 134 may be sealed (e.g., bonded) to the interior side 121 of the lower portion 128 below the access slot 124, and the second profile 136 may be sealed to the interior side 121 of the upper portion 126 above the access slot 124. The first and second profiles 134, 136 are fixedly attached to the front panel 106 during the assembly process, such as in a vertical form fill and seal (VFFS) packing line. An advantage of the front-panel reclosable mechanism 120 described herein is that the zipper profiles 134, 136 can be entirely pre-applied on a flat web of film prior to the forming of the package. The reclosable mechanism 120 may require no additional sealing of the zipper profiles 134, 136 to the web during the package forming process or filling process.

The reclosable mechanism 120 is located along the access slot 124. For example, one or both of the first and second profiles 134, 136 may overlap the access slot 124. The zipper 122 is open (e.g., fluidly connected) to the access slot 124, such that the zipper 122 is accessible to a user through the access slot 124. Outside of the access slot 124 the zipper 122 is obstructed by the front panel 106. The reclosable mechanism 120 includes a user tab 140 that is accessible through the access slot 124. The user tab 140 is configured to assist in separating the first and second profiles 134, 136 to provide an opening to the interior cavity 110 of the reclosable enclosure 100.

Figure 3:
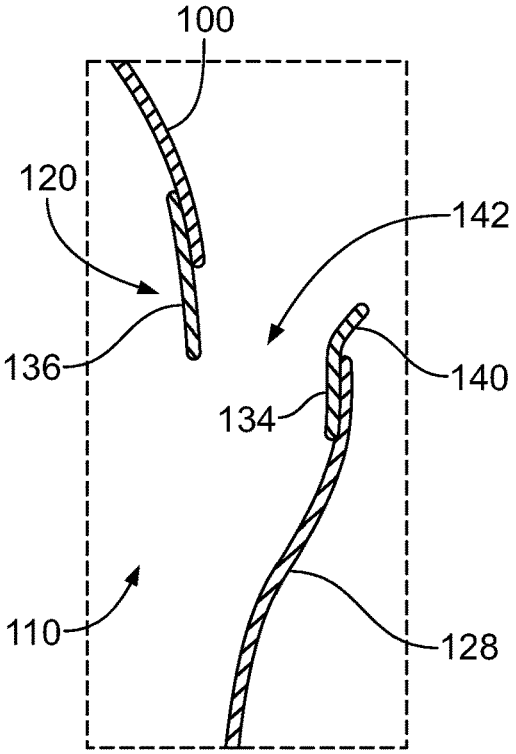
FIG. 3 illustrates a close-up view of a reclosable mechanism of the reclosable enclosure in an open state.

FIG. 3 illustrates a close-up view of the reclosable mechanism 120 of the enclosure 100 in an open state. To open the enclosure 100, a user accesses the user tab 140 of the reclosable mechanism 120 through the access slot 124 (shown in FIGS. 1 and 2). The user grips the tab 140 and pulls the tab 140 to disconnect and separate the first and second profiles 134, 136, which forms an opening 142 to the interior cavity 110. When the profiles 134, 136 are separated, the user can access the contents within the interior cavity 110. The user can pull the lower portion 128 of the front panel 106 in a direction away from the back panel 108 to enlarge the opening 142.

Figure 4:
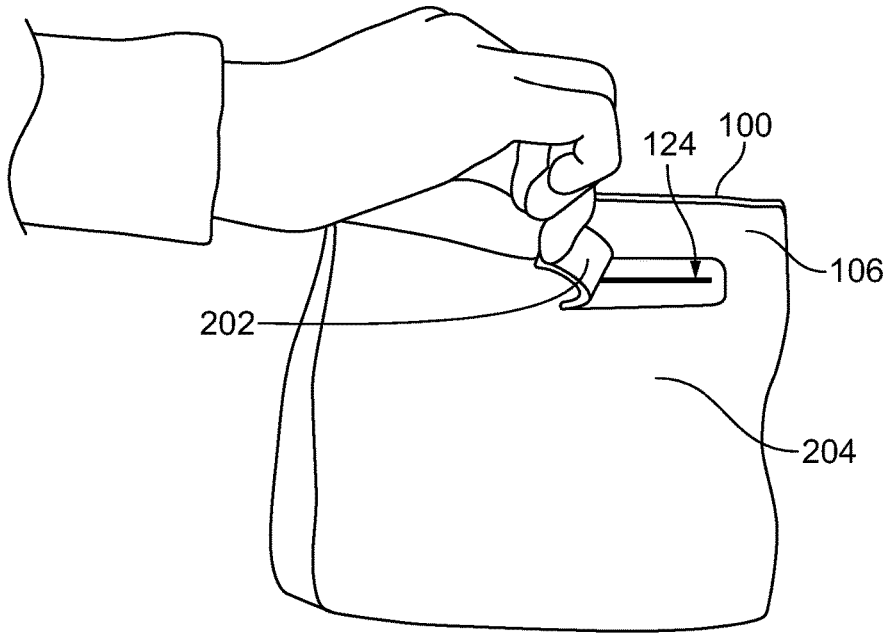
FIG. 4 illustrates a front perspective view of the reclosable enclosure according to an embodiment.

FIG. 4 illustrates a front perspective view of the reclosable enclosure 100 according to an embodiment. The enclosure 100 in FIG. 4 includes a removable strip 202 along the exterior side 204 of the front panel 106. The exterior side 204 is opposite the interior side 121 (shown in FIG. 2). The strip 202 covers the access slot 124. The strip 202 is removable from the front panel 106. For example, the strip 202 may be attached to the front panel 106 by an adhesive that allows the strip 202 to peel away from the front panel 106 without damaging the front panel 106. In another example, the strip 202 may be configured to tear away from the front panel 106 via perforations that define a line or boundary of weakness. The strip 202 may have a loose end flap that enables a user to grip the strip 202 and pull the strip 202 off the front panel 106. The access slot 124 is exposed upon at least partially removing the strip 202. In an alternative embodiment, the front panel 106 includes a line of weakness, and the access slot 124 is formed upon breaking the line of weakness. For example, the line of weakness may be a perforated lateral line.

Figure 5:
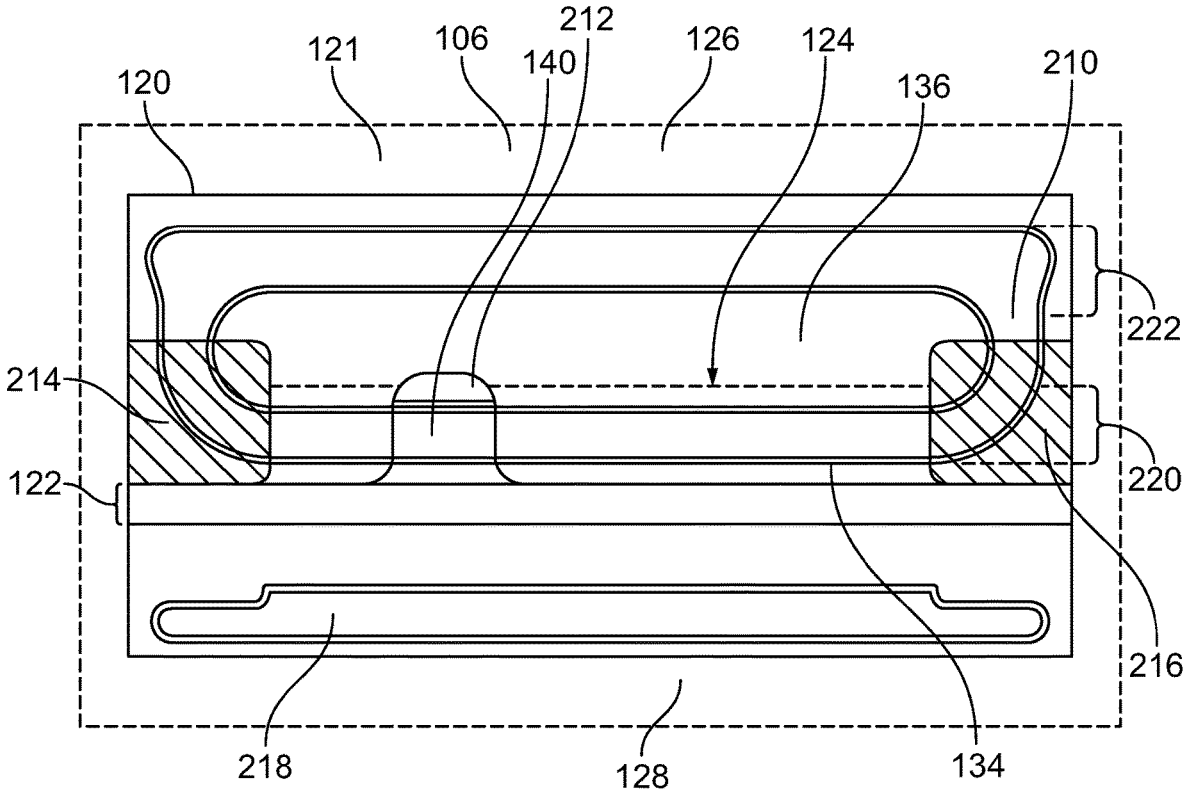
FIG. 5 illustrates the reclosable mechanism of the reclosable enclosure according to an embodiment.

FIG. 5 illustrates the reclosable mechanism 120 of the reclosable enclosure 100 according to an embodiment. The reclosable mechanism 120, disposed along the interior side 121 of the front panel 106, is shown in the perspective from inside the interior cavity 110 (shown in FIG. 2). The reclosable mechanism 120 includes a race-track seal 210 that secures the first profile 134 and/or the second profile 136 to the interior side 121 of the front panel 106. The race-track seal 210 surrounds the access slot 124, which is shown in phantom in FIG. 5 because the access slot 124 is behind the reclosable mechanism 120. The first and second profiles 134, 136 overlap each other at least along the zipper 122. The tab 140 of the first profile 134 projects beyond the zipper 122 towards the access slot 124. In the illustrated embodiment, the tab 140 projects upward from the zipper 122. The tab 140 optionally can have a graphic indicator, such as a colored tip 212, to draw attention of the user.

The first profile 134 and the second profile 136 are coupled to each other at first and second crushed sections 214, 216. The crushed sections 214, 216 reinforce the reclosable mechanism 120 and withstand forces that pull the first and second profiles 134, 136 away from each other. The reclosable mechanism 120 may include one or more additional seal sections, such as a tack seal 218, to fixedly attach the reclosable mechanism 120 to the front panel 106.

In operation, when the user separates the first and second profiles 134, 136 to form the opening 142 (shown in FIG. 3) and access the interior cavity 110, the opening 142 is laterally defined between the first and second crushed sections 214, 216 and vertically or longitudinally (e.g., in the depth direction) by the first and second profiles 134, 136. Furthermore, the opening 142 may be surrounded by the race-track seal 210. In an non-limiting example, a bottom portion 220 of the race-track seal 210 engages the first profile 134 to seal the first profile 134 to the lower portion 128 of the front panel 106, and a top portion 222 of the race-track seal 210 engages the second profile 136 to seal the second profile 136 to the upper portion 126 of the front panel 106. When the lower portion 128 is pulled outward (e.g., away from the back panel 108 and the upper portion 126), the bottom portion 220 of the race-track seal 210 may move with the lower portion 128 and the first profile 134 relative to the top portion 222 of the race-track seal 210.

Figure 6:
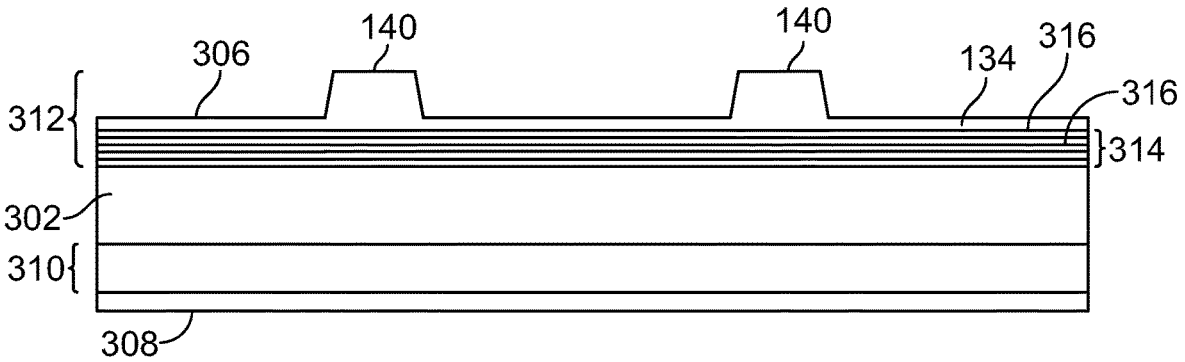
FIG. 6 shows a first profile of the reclosable mechanism according to a first embodiment.
Figure 7:
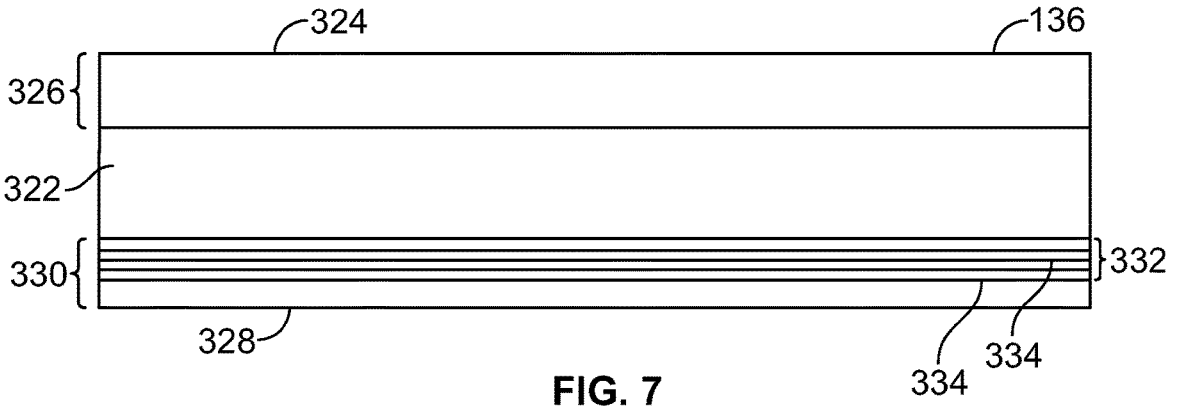
FIG. 7 shows a second profile of the reclosable mechanism according to the first embodiment.
Figure 8:
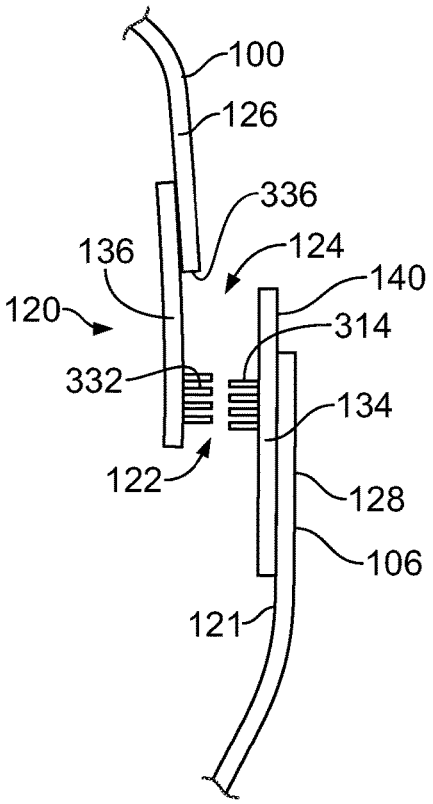
FIG. 8 is a cross-sectional view of a portion of the reclosable enclosure according to the first embodiment with the first and second profiles poised for coupling.

FIGS. 6-8 illustrate the reclosable mechanism 120 according to a first embodiment. FIG. 6 shows the first profile 134, and FIG. 7 shows the second profile 136. The illustrated surfaces of the first and second profiles 134, 136 in FIGS. 6 and 7 are the surfaces that face each other and mechanically contact each other when the reclosable mechanism 120 is in the closed state. FIG. 8 is a cross-sectional view of a portion of the reclosable enclosure 100 with the first and second profiles 134, 136 poised for coupling.

In FIG. 6, the first profile 134 includes a generally rectangular strip-like portion of web 302. The first profile 134 has at least one tab 140 (e.g., user tab). Two tabs 140 are shown in FIG. 6, but the first profile 134 may have only a single tab or at least three tabs in other embodiments. For example, the tabs 140 may be spaced apart such that only a single tab 140 is included within the width of a single reclosable mechanism 120. The tabs 140 project from an upper edge 306 of the first profile 134 in the illustrated embodiment. The tabs 140 are free-standing flaps. The tabs 140 are sized and shaped to be relatively small but large enough to enable an adult finger and thumb to grip and grasp the tab 140. For example, the tabs 140 may be no more than 10 mm tall and 20 mm wide.

A lower portion of first profile 134 proximate to a lower edge 308 of the profile 134 is a sealing flange 310. An upper portion of the first profile 134 between the sealing flange 310 and the upper edge 306 is a separable upper flange 312. The separable upper flange 312 extends from the sealing flange 310 and includes a first interlocking element 314. The first interlocking element 314 may include parallel protrusions 316 that define tracks continuously extending along the width of the first profile 134. The separable upper flange 312 also includes the tabs 140. In FIG. 8, the sealing flange 310 is fixedly attached to the interior side 121 of the front panel 106 along the lower portion 128. The sealing flange 310 defines a lower sealed portion of the first profile 134. The separable upper flange 312 of the first profile 134 in FIG. 8 is adjacent the front panel 106 but not directly attached to the front panel 106.

In FIG. 7, the second profile 136 includes a generally rectangular strip-like portion of web 322. An upper portion of second profile 136 proximate to an upper edge 324 of the second profile 136 is a sealing flange 326. Below the sealing flange 326 more proximate to a lower edge 328 of the second profile 136 is a separable flange 330 that includes a second interlocking element 332. The second interlocking element 332 may include parallel protrusions 334 that define tracks continuously extending along the width of the second profile 136. In FIG. 8, the sealing flange 326 is fixedly attached to the interior side 121 of the front panel 106 along the upper portion 126. The separable flange 330 of the second profile 136 in FIG. 8 is not directly attached to the front panel 106. For example, the second profile 136 may project below an edge 336 of the upper portion 126 of the front panel 106 at the access slot 124. The second interlocking element 332 is disposed on a common side of the second profile 136 as the surface that engages and seals to the interior side 121 of the front panel 106. The first interlocking element 314, however, is disposed on an opposite side of the first profile 134 from the surface that engages and seals to the interior side 121 of the front panel 106.

The first and second interlocking elements 314, 332 are separably connectable to provide the zipper 122. For example, the first interlocking element 314 is complementary to, and releasably interlockable with, the second interlocking element 332. As shown in FIG. 8, pressing the first and second interlocking elements 314, 332 together causes the elements 314, 332 to interlock with each other, closing the zipper 122. The tab 140 projects above the zipper 122 towards the access slot 124. The access slot 124 can be at least partially opened without separating the first and second interlocking elements 314, 332. For example, the separable upper flange 312 of the first profile 134 (which includes the first interlocking element 314 and the tab 140) can be at least partially separated from the interior side 121 of the front panel 106 while the first and second interlocking elements 314, 332 are connected to each other. In this arrangement, pulling the front panel 106 alone, without pulling the tab 140, may not provide sufficient force on the zipper 122 to disconnect the first and second interlocking elements 314, 332 for opening the enclosure 100. In one or more embodiments described herein, the interlocking elements, such as but not limited to the elements 314, 332, may have a discontinuous shape along the length. The discontinuous shape can include cuts, indentations, or other features that create audible and/or tactile feedback when opened and/or closed.

Figure 9:
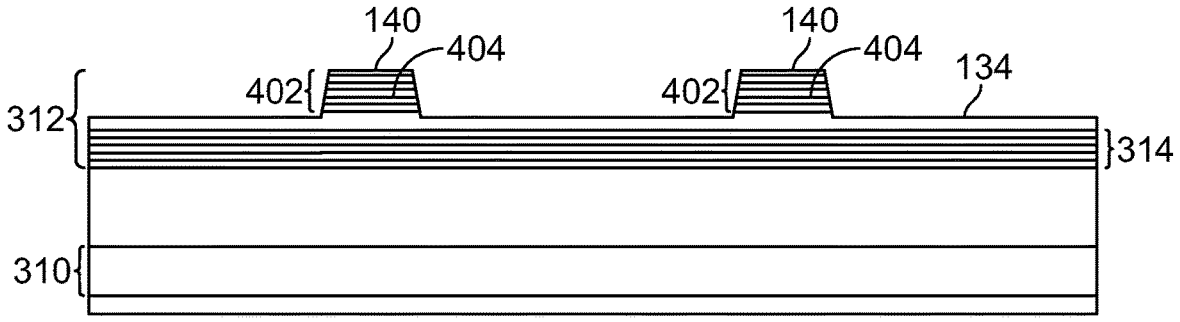
FIG. 9 shows the first profile of the reclosable mechanism according to a second embodiment.
Figure 10:
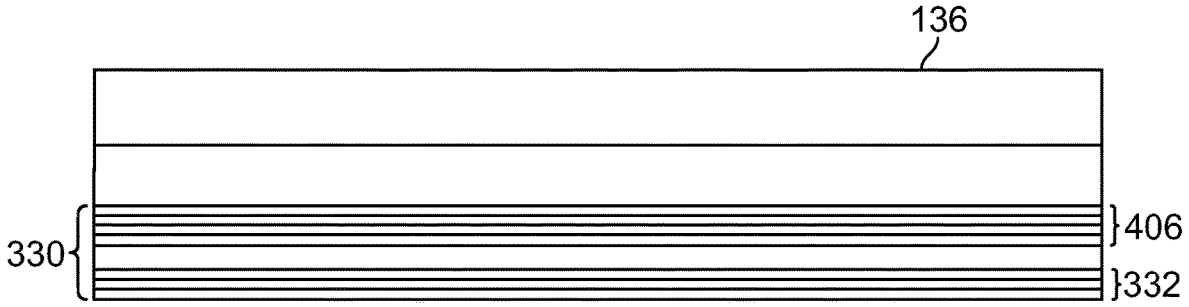
FIG. 10 shows the second profile of the reclosable mechanism according to the second embodiment.
Figure 11:
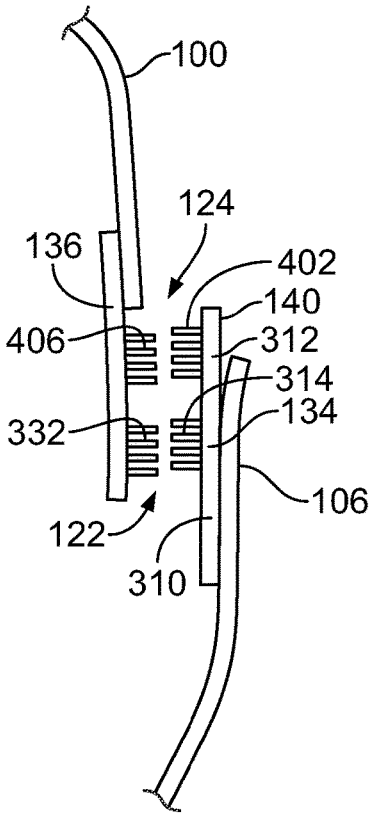
FIG. 11 is a cross-sectional view of a portion of the reclosable enclosure according to the second embodiment with the first and second profiles poised for coupling.

FIGS. 9-11 illustrate the reclosable mechanism 120 according to a second embodiment. FIG. 9 shows the first profile 134, and FIG. 10 shows the second profile 136. FIG. 11 is a cross-sectional view of a portion of the reclosable enclosure 100 with the first and second profiles 134, 136 poised for coupling.

In FIG. 9, the first interlocking element 314 of the first profile 134 is a lower interlocking element, and the tabs 140 include interlocking elements disposed above the first lower interlocking element 314. The interlocking elements on the tabs 140 are tab-locking elements 402. In an embodiment, each of the tabs 140 has a respective tab-locking element 402. The tab-locking element 402 includes parallel protrusions 404 that define tracks continuously extending along the width of the respective tab 140. The protrusions 404 may be similar in shape, spacing, and function as the protrusions 316 on the lower interlocking element 314 with a significantly shorter length than the protrusions 316.

In FIG. 10, the second profile 136 has two interlocking elements. The interlocking element 332 is a second lower interlocking element, and the second profile 136 has a second upper interlocking element 406. The upper interlocking element 406 may be similar to the lower interlocking element 332, such that both define tracks that continuously extend along the width of the second profile 136. The tracks of the upper interlocking element 406 are parallel to the tracks of the lower interlocking element 332. Both the upper and lower interlocking elements 406, 332 are disposed along the separable flange 330.

As shown in FIG. 11, the first lower interlocking element 314 of the first profile 134 is separably connectable to the second lower interlocking element 332 of the second profile 136 to form the zipper 122. The tab-locking element 402 of each tab 140 on the first profile 134 is separably connectable to the second upper interlocking element 406 of the second profile 136. Because the separable upper flange 312 of the first profile 134 can be separate from the front panel 106 while the first profile 134 remains fixedly attached to the front panel 106 via the sealing flange 310, the tab-locking element 402 can remain connected to the second upper interlocking element 406 even when the access slot 124 is at least partially open. In operation, a user can open the enclosure 100 by enlarging the access slot 124 to access and locate the tab 140. The tab 140 is interlocked with the second upper interlocking element 406, so the user can use a finger or tool to pry the tab 140 away from the second upper interlocking element 406. Once separated, the user can grip and pull the tab 140 away from the second profile 136 to disconnect the first and second lower interconnecting elements 314, 332, as described above with reference to FIG. 8.

Figure 12:
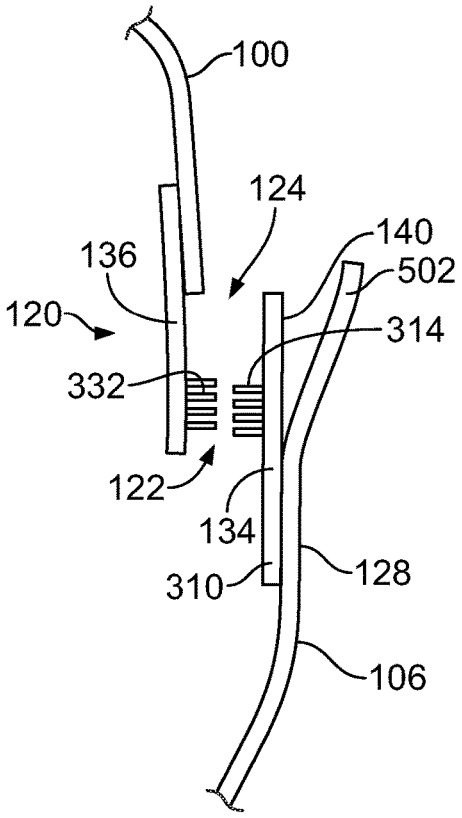
FIG. 12 shows an embodiment of the reclosable enclosure with a pull flap along a front panel of the reclosable enclosure.

In the embodiments shown in FIGS. 8 and 11, the tab 140 is at least partially exposed within the access slot 124 or can be accessed by inserting a finger into the access slot 124 to enlarge the clearance. FIG. 12 shows an optional embodiment of the reclosable enclosure 100 in which the front panel 106 forms a pull flap 502. The pull flap 502 projects above the upper edge 306 (shown in FIG. 6) of the first profile 134 and may extend beyond the top of the tab 140. The pull flap 502 may be an integral extension of the lower portion 128 of the front panel 106. The pull flap 502 is designed to be pulled outward by a user to enlarge the access slot 124 and provide access to the tab 140. The reclosable mechanism 120 is designed such that pulling the flap 502 alone, without pulling the tab 140, is not sufficient to separate the zipper 122 (e.g., the interlocking elements 314, 332 of the profiles 134, 136) when connected. For example, force exerts on the flap 502 is transferred to the sealing flange 310 of the first profile 134 below the zipper 122. The tab 140 is pulled to pry the interlocking elements 314, 332 apart. Although FIG. 12 shows the first embodiment of FIG. 8, the pull flap 502 can also be used on the second embodiment shown in FIG. 11 and other embodiments.

Figure 13:
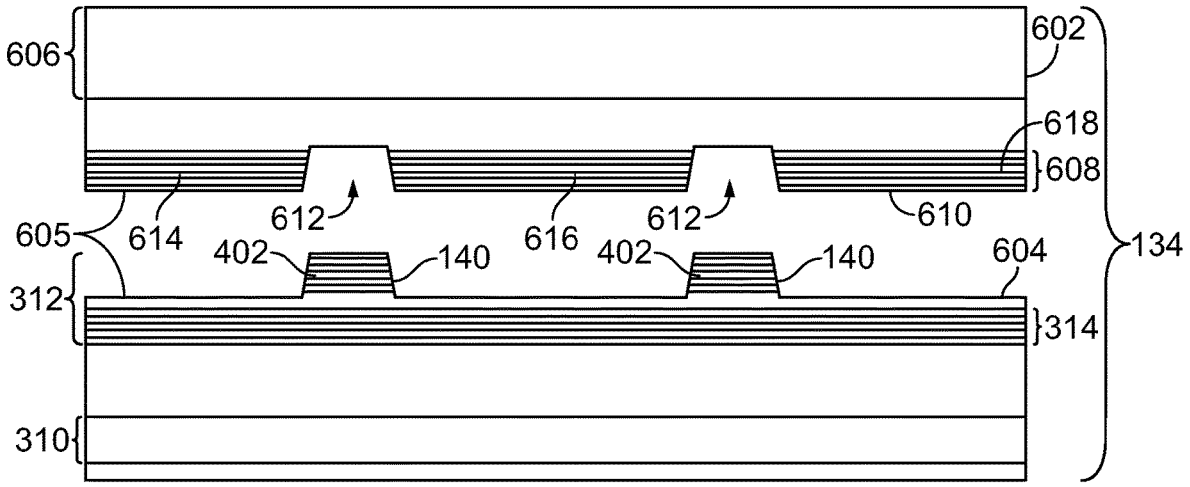
FIG. 13 shows the first profile of the reclosable mechanism according to a third embodiment.
Figure 14:
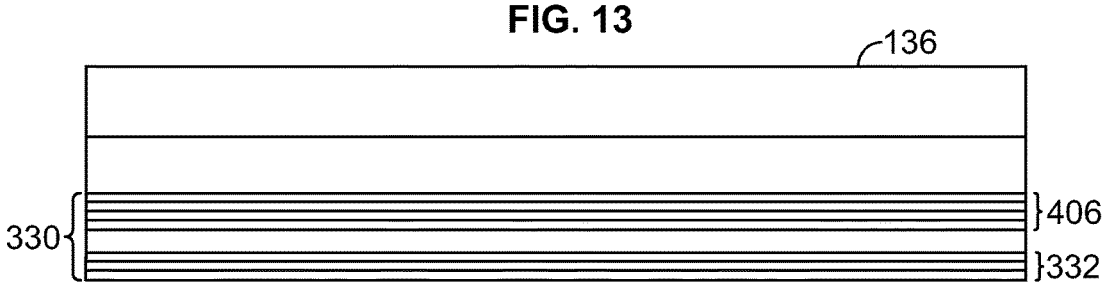
FIG. 14 shows the second profile of the reclosable mechanism according to the third embodiment.
Figure 15:
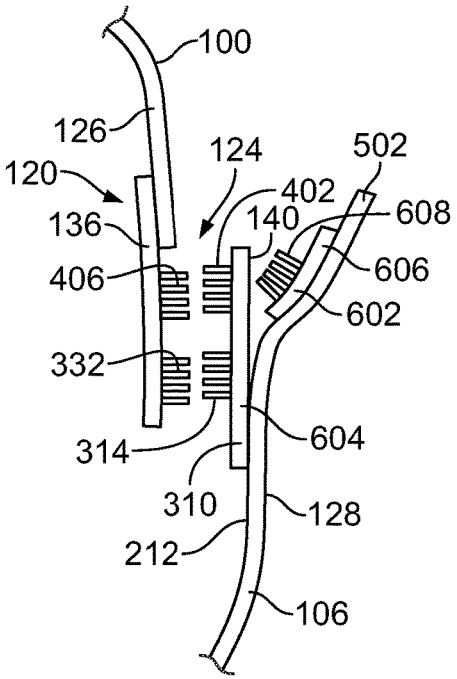
FIG. 15 is a cross-sectional view of a portion of the reclosable enclosure according to the third embodiment with the first and second profiles poised for coupling.

FIGS. 13-15 illustrate the reclosable mechanism 120 according to a third embodiment. FIG. 13 shows the first profile 134, and FIG. 14 shows the second profile 136. FIG. 15 is a cross-sectional view of a portion of the reclosable enclosure 100 with the first and second profiles 134, 136 poised for coupling. The second profile 136 shown in FIG. 14 is unchanged from the second profile 136 of the second embodiment shown in FIG. 10. For example, the second profile 136 includes the separable flange 330 with the second upper interlocking element 406 above the second lower interlocking element 332.

In FIG. 13, the first profile 134 is defined by two discrete profile sections, including an upper profile section 602 and a lower profile section 604. The upper and lower profile sections 602, 604 may be formed by cutting a single web along a partition line 605. The lower profile section 604 may be the same or similar to the first profile 134 of the second embodiment shown in FIG. 9. For example, the lower profile section 604 includes the separable flange 312 with the first lower interlocking element 314 below the tab-locking elements 402 on the tabs 140. The lower profile section 604 also includes the sealing flange 310 that fixedly attaches to the interior side 121 of the front panel 106 along the lower portion 128.

The upper profile section 602 of the first profile 134 includes a sealing flange 606 along an upper portion thereof and a first upper interlocking element 608 proximate to a bottom edge 610 of the upper profile section 602. The upper profile section 602 defines one or more gaps 612 that divide the first upper interlocking element 608 into multiple segments. In the illustrated embodiment, two gaps 612 divide the first upper interlocking element 608 into a first segment 614, a second segment 616, and a third segment 618 along the length of the element 608. The gaps 612 may be cut-outs defined when forming the tabs 140 of the lower profile section 604. For example, the tabs 140 may be defined by the severed portions of the first upper interlocking element 608.

As shown in FIG. 15, the upper and lower profile sections 602, 604 of the first profile 134 are separately and independently fixedly attached to the front panel 106 along the lower portion 128. For example, the scaling flange 606 of the upper profile section 602 may seal to the interior side 121 to secure the upper profile section 602 to the front panel 106. The sealing flange 310 of the lower profile section 604 seals to the interior side 121 at a lower position to secure the lower profile section 604 to the front panel 106. The upper and lower profile sections 602, 604 are positioned to enable the tabs 140 of the lower profile section 604 to align with and be received in the corresponding gaps 612 when the reclosable mechanism 120 is in the closed state. Furthermore, the first upper interlocking element 608 may be parallel to the first lower interlocking element 314. When the tabs 140 are received in the gaps 612, the tab-locking elements 402 and the segments 614, 616, 618 of the first upper interlocking element 608 may combine to define a continuously extending set of parallel tracks along the length of the first profile 134. The tab-locking elements 402 and the segments 614, 616, 618 of the first upper interlocking element 608 are each separably connectable (e.g., releasably interlockable) with the second upper interlocking element 406 of the second profile 136. Because the upper profile section 602 (which includes the first upper interlocking element 608) is separate and discrete from the lower profile section 604 (which includes the tab-locking elements 402), the first upper interlocking element 608 can be separated from the second upper interlocking element 406 while the tab-locking elements 402 remain connected to the second upper interlocking element 406.

When the reclosable mechanism 120 is closed, the first and second lower interlocking elements 314, 332 are interlocked and the first and second upper interlocking elements 608, 406 are interlocked. The reclosable mechanism 120 can be opened by first pulling the lower portion 128 of the front panel 106 to enlarge the access slot 124. A user can grab and pull the flap 502 of the front panel 106 to enlarge the access slot 124. Pulling apart the upper and lower portions 126, 128 of the front panel 106 causes the first upper interlocking element 608 of the upper profile section 602 to separate from the second upper interlocking element 406, which exposes the tab 140. For example, the segments 614, 616, 618 pull apart from the second upper interlocking element 406 of the second profile 136 while the tab-locking element 402 remain connected to the second upper interlocking element 406. The user then lifts and peels the tab 140 from the second upper interlocking element 406. The user grips the released tab 140 and pulls the tab 140 outward away from the second profile 136 to separate the first and second lower interlocking elements 314, 332 from each other. The separation of the interlocking element 314, 332 represents the opening of the reclosable mechanism 120 and provides access to the contents within the interior cavity 110 (shown in FIG. 2). Closing the reclosable mechanism 120 can be provided by simply pressing the front and back panels 106, 108 (shown in FIG. 2) together and sliding pressure along the length of the reclosable mechanism to cause the corresponding interlocking elements to engage.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are example embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A reclosable enclosure comprising:

a front panel and a back panel coupled to each other and forming an interior cavity therebetween, the front panel configured to form an access slot that extends widthwise along the front panel; and a reclosable mechanism coupled to an interior side of the front panel along the access slot, the reclosable mechanism having a first profile and a second profile forming a zipper, wherein the first profile includes a user tab projecting upward from an upper edge of the first profile, the user tab accessible through the access slot, the user tab configured to assist in separating the first and second profiles to provide an opening to the interior cavity of the reclosable enclosure, the first profile and the second profile coupled to each other at first and second crushed sections, the first and second profiles defining the opening to the interior cavity between the first and second crushed sections when the first and second profiles are separated the first profile includes a first interlocking element and the second profile includes a second interlocking element, the first and second interlocking elements being separably connectable to provide the zipper, wherein the user tab of the first profile projects from the upper edge of the first profile toward the access slot; and the first profile includes a lower sealed portion fixedly attached to the interior side of the front panel and a separable upper flange extending from the lower sealed portion, the separable upper flange including the first interlocking element and the user tab, the separable upper flange configured to be separated from the interior side of the front panel while the first and second interlocking elements are connected to each other, thereby permitting the access slot to at least partially open without separating the first and second interlocking elements.

2. The reclosable enclosure of claim 1, wherein the reclosable mechanism includes a race-track seal that secures at least one of the first profile or the second profile to the interior side of the front panel, the race-track seal surrounding the access slot.

3. The reclosable enclosure of claim 1, wherein the front panel forms a pull flap that projects above the upper edge of the first profile, the pull flap configured to be pulled by a user to enlarge the access slot and provide access to the user tab.

4. The reclosable enclosure of claim 1, wherein the front panel includes a removable strip on an exterior surface of the front panel covering the access slot, the access slot being exposed after the removable strip is at least partially removed.

5. The reclosable enclosure of claim 1, wherein the front panel includes a line of weakness, the access slot being formed after the line of weakness is broken.

6. The reclosable enclosure of claim 1, wherein the front panel includes an upper portion above the access slot and a lower portion below the access slot, the upper portion integrally connected to the lower portion at opposite ends of the access slot, wherein the first profile is fixedly attached to the lower portion and the second profile is fixedly attached to the upper portion.

7. The reclosable enclosure of claim 1, wherein the reclosable mechanism is discrete and spaced apart from the back panel.

8. The reclosable enclosure of claim 1, wherein the first profile has a first lower interlocking element extending continuously along the first profile and the user tab includes a tab-locking element, the second profile having a second lower interlocking element and a second upper interlocking element that both extend continuously along the second profile, wherein the first and second lower interlocking elements are separably connectable to provide the zipper and the tab-locking element is separably connectable to the second upper interlocking element of the second profile.

9. The reclosable enclosure of claim 8, wherein the first profile includes a first upper interlocking element parallel to the first lower interlocking element, the user tab configured to be received in a gap between first and second segments of the first upper interlocking element, wherein the first and second upper interlocking elements are separably connectable to each other and configured to be separated from each other while the tab-locking element remains connected to the second upper interlocking element.

10. A reclosable enclosure comprising:

a front panel and a back panel coupled to each other and forming an interior cavity therebetween, the front panel configured to form an access slot that extends widthwise along the front panel; and a reclosable mechanism coupled to an interior side of the front panel along the access slot, the reclosable mechanism having a first profile and a second profile, the first profile including a first interlocking element and the second profile including a second interlocking element, the first and second interlocking elements being separably connectable to provide a zipper, the first profile also including a user tab that projects upward from an upper edge of the first profile, the user tab accessible through the access slot and configured to assist in separating the first and second interlocking elements to provide an opening to the interior cavity of the reclosable enclosure;

wherein the first profile includes a lower sealed portion fixedly attached to the interior side of the front panel and a separable upper flange extending from the lower sealed portion, the first interlocking element and the user tab disposed on the separable upper flange, the separable upper flange configured to be separated from the interior side of the front panel while the first and second interlocking elements are connected to each other, thereby permitting the access slot to at least partially open without separating the first and second interlocking elements, the first profile and the second profile coupled to each other at first and second crushed sections, the first and second profiles defining the opening to the interior cavity between the first and second crushed sections when the first and second profiles are separated.

11. The reclosable enclosure of claim 10, wherein the user tab is a free-standing flap that projects from the upper edge of the first profile along the separable upper flange.

12. The reclosable enclosure of claim 10, wherein the front panel forms a pull flap that projects above the upper edge of the first profile, the pull flap configured to be pulled by a user to enlarge the access slot and provide access to the user tab.

13. The reclosable enclosure of claim 10, wherein the reclosable mechanism includes a race-track seal that secures at least one of the first profile or the second profile to the interior side of the front panel, the race-track seal surrounding the access slot.

14. The reclosable enclosure of claim 10, wherein the front panel includes a removable strip on an exterior surface of the front panel covering the access slot, the access slot being exposed after the removable strip is at least partially removed.

15. The reclosable enclosure of claim 1, wherein the user tab includes a tab-locking element that aligns with and is separably connectable to the upper interlocking element of the second profile.

16. The reclosable enclosure of claim 1, wherein the user tab is a first tab, and further comprising at least a second tab projecting upward from an upper edge of the first profile and spaced apart from the first tab.

* * * * *